US006679155B1

(12) United States Patent
Yaschur et al.

(10) Patent No.: US 6,679,155 B1
(45) Date of Patent: Jan. 20, 2004

(54) PROJECTILE LAUNCHER

(75) Inventors: Jeffery C. Yaschur, Smyrna, GA (US); John T. Applewhite, Atlanta, GA (US); Lonnie G. Johnson, Atlanta, GA (US)

(73) Assignee: Johnson Research & Development Co., Inc., Atlanta, GA (US)

( * ) Notice: Subject to any disclaimer, the term of this patent is extended or adjusted under 35 U.S.C. 154(b) by 0 days.

(21) Appl. No.: 10/278,958

(22) Filed: Oct. 24, 2002

(51) Int. Cl.[7] ..... F41F 3/04

(52) U.S. Cl. ..... 89/1.813; 89/1.814; 446/429; 124/56

(58) Field of Search ..... 446/429; 89/1.813, 89/1.814; 124/56, 63–69

(56) References Cited

U.S. PATENT DOCUMENTS

| | | | | | |
|---|---|---|---|---|---|
| 2,147,003 | A | | 2/1939 | Kozurik | 124/11 |
| 2,312,244 | A | | 2/1943 | Feltman | 124/11 |
| 2,357,951 | A | | 9/1944 | Hale | 124/11 |
| 2,409,653 | A | | 10/1946 | Amdur | 124/11 |
| 2,505,428 | A | | 4/1950 | Pope | 124/11 |
| 2,733,699 | A | | 2/1956 | Krinsky | 124/13 |
| 2,927,398 | A | | 3/1960 | Kaye et al. | 46/74 |
| 3,025,633 | A | | 3/1962 | Kaye et al. | 46/74 |
| 3,049,832 | A | | 8/1962 | Joffe | 46/74 |
| 3,121,292 | A | | 2/1964 | Butler et al. | 46/74 |
| 3,218,755 | A | | 11/1965 | Quercetti | 46/86 |
| 3,308,803 | A | | 3/1967 | Walther | 124/13 |
| 3,397,476 | A | | 8/1968 | Weber | 43/6 |
| 3,415,010 | A | | 12/1968 | Belz | 46/241 |
| 3,510,980 | A | | 5/1970 | Pippin, Jr. | 46/74 |
| 3,807,274 | A | * | 4/1974 | Cohen | 89/1.81 |
| 3,943,656 | A | | 3/1976 | Green | 46/74 |
| 3,962,818 | A | | 6/1976 | Pippin, Jr. | 46/74 |
| 4,004,566 | A | | 1/1977 | Fischer | 124/59 |
| 4,073,280 | A | | 2/1978 | Koehn et al. | 124/72 |
| 4,083,349 | A | | 4/1978 | Clifford | 124/72 |
| 4,159,705 | A | | 7/1979 | Jacoby | 124/63 |
| 4,223,472 | A | | 9/1980 | Fekete et al. | 46/44 |
| 4,411,249 | A | | 10/1983 | Fogarty et al. | 124/64 |
| 4,819,609 | A | | 4/1989 | Tippmann | 124/72 |
| 4,848,307 | A | | 7/1989 | Tsao | 124/59 |
| 5,012,719 | A | * | 5/1991 | Goldstein et al. | 89/8 |
| 5,280,778 | A | | 1/1994 | Kotsiopoulos | 124/73 |
| 5,339,791 | A | | 8/1994 | Sullivan | 124/73 |
| 5,343,849 | A | | 9/1994 | Steer | 124/72 |
| 5,373,832 | A | | 12/1994 | D'Andrade | 124/69 |
| 5,415,152 | A | | 5/1995 | Adamson et al. | 124/59 |
| 5,515,837 | A | | 5/1996 | Nin et al. | 124/59 |
| 5,529,050 | A | | 6/1996 | D'Andrade | 124/56 |
| 5,553,598 | A | | 9/1996 | Johnson et al. | 124/63 |
| 5,605,140 | A | | 2/1997 | Griffin | 124/59 |
| 5,878,734 | A | | 3/1999 | Johnson et al. | 124/59 |
| 6,489,049 | B1 | * | 12/2002 | Johnson | 429/13 |
| 2002/0160237 | A1 | * | 10/2002 | Johnson | 429/9 |

FOREIGN PATENT DOCUMENTS

| | | |
|---|---|---|
| FR | 2587911 A1 | 10/1985 |

* cited by examiner

*Primary Examiner*—Michael J. Carone
*Assistant Examiner*—Troy Chambers
(74) *Attorney, Agent, or Firm*—Baker Donelso

(57) ABSTRACT

A launcher (10) is provided having a separation unit (15) and a launch tube (16) in fluid communication with the separation unit (15). The separation unit (15) has a pressure sensing chamber (23) for sensing the pressure within the separation unit (15), a separation chamber (24) in fluid communication with the pressure sensing chamber (23), and a combustion chamber (26) in fluid communication with the separation chamber (24). The combustion chamber (26) is in fluid communication with the launch tube (16) through opening (28). The rocket launcher (10) also includes a hydrogen separation circuit (21) and an ignition circuit (22). The hydrogen separation circuit (21) includes a battery pack (44) electrically coupled to a fuel cell (45) which when powered separates water into hydrogen gas and oxygen gas. The ignition circuit (22) includes a piezoelectric spark generator (61) for igniting the hydrogen gas produced by the fuel cell and contained within the combustion.

12 Claims, 3 Drawing Sheets

PROJECTILE LAUNCHER

TECHNICAL FIELD OF THE INVENTION

The present invention relates generally to projectile launchers and more particular to toy vehicle launchers which utilize combustible gas as a propellant.

BACKGROUND OF THE INVENTION

For decades, projectile launchers and especially toy rockets have been popular playthings for children of all ages. Such rockets have been made available in all shapes and sizes and many models have been provided with their own propellant. Most toy rockets that have been the playthings of children are designed to be launched by one of various means into the air for flight.

One method of launching rockets has been with the use of solid fuel rocket engines. These solid fuel rocket engines provide ample thrust to launch a rocket several hundred feet into the air. However, there are many dangers involved with the use of solid fuel engines. For instance, once the engine is ignited its burn can not be stopped until the entire fuel supply of the engine has been utilized.

Rockets have also been designed to include a pressure tank in which pressurized air or water is stored and expelled through a nozzle in order to propel the rocket, as shown in U.S. Pat. No. 5,415,153. However, once these rockets are fully pressurized they cannot be removed from the launcher without firing the rocket. Many of these types of rockets do not include safety mechanisms which prevent the rocket from firing should it be oriented in a position other than vertical. As such, many of these rockets may be accidentally or purposely fired at people or property.

Another popular method of launching toy rockets has been with a launcher which utilizes compressed air behind the rocket to propel it forward, as shown in U.S. Pat. No. 5,653,216. While these rockets do not utilize dangerous solid fuel burning engines they typically do not have enough power to propel the rocket to great heights.

Accordingly, it is seen that a need remains for a launcher that can propel a vehicle such as a rocket with a great velocity but without a prolong burning of fuel. It is to the provision of such therefore that the present invention is primarily directed.

SUMMARY OF THE INVENTION

In a preferred form of the invention a launcher adapted to launch a projectile comprises a combustion chamber, a launch tube in fluid communication with the combustion chamber configured to receive a projectile, a separation chamber in fluid communication with the combustion chamber, a fuel cell mounted within the separation chamber adapted to isolate hydrogen from a supply of water, a power supply electrically coupled to the fuel cell, and spark generating means mounted within the combustion chamber for generating a spark to ignite gases within the combustion chamber. With this construction, water is positioned within the separation chamber so as to immerse the fuel cell, whereby energy supplied to the fuel cell causes it to convert a portion of the water into hydrogen gas and oxygen gas, and whereby the spark generating means ignites the hydrogen gas causing a rapid pressurization of the launch tube which causes a projectile thereon to be propelled.

DETAILED DESCRIPTION

Figure 1:
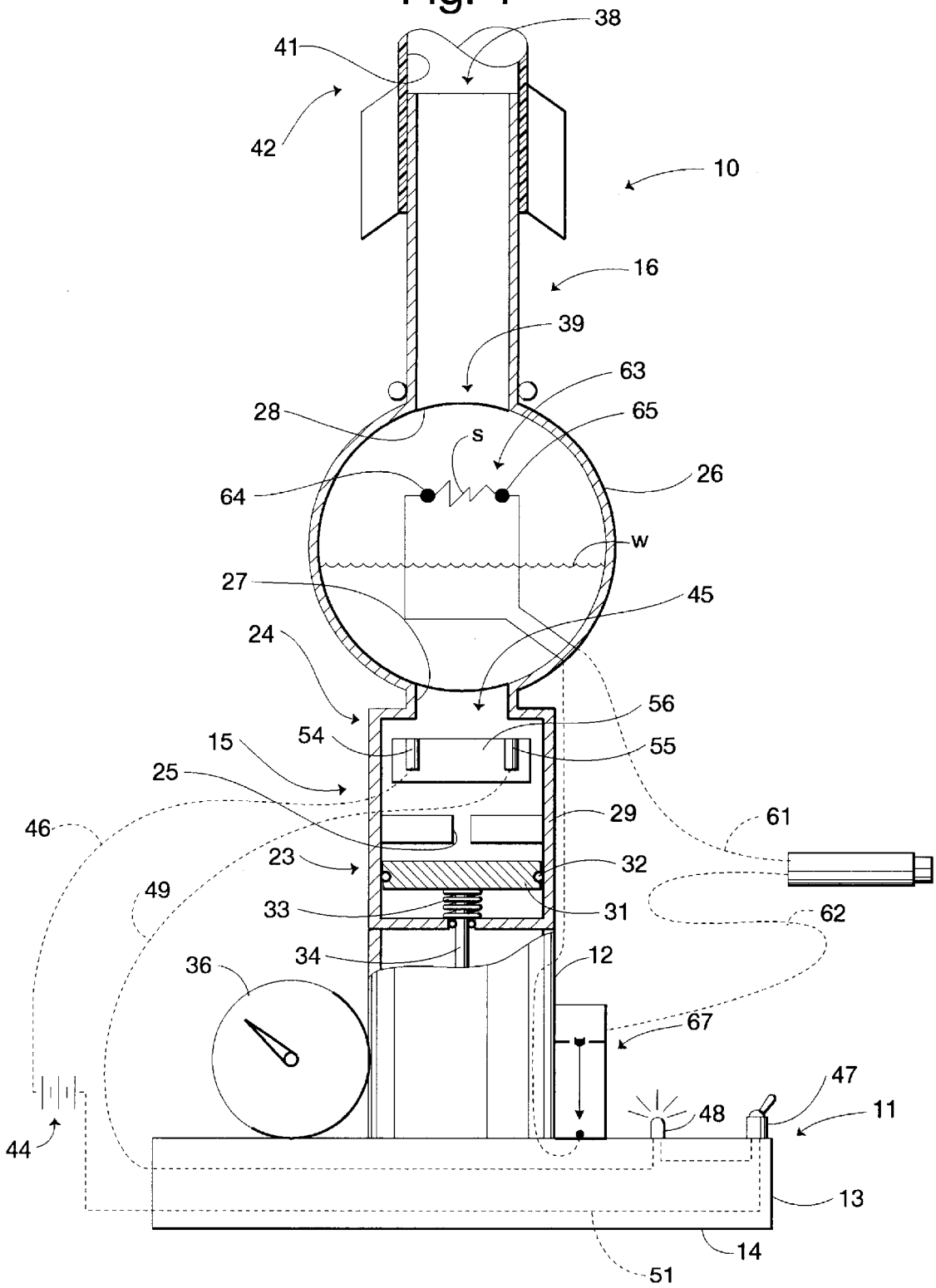
FIG. 1 is a side view shown in partial cross-section of a vehicle launcher and toy rocket embodying principals of the present invention in a preferred form.
Figure 2:
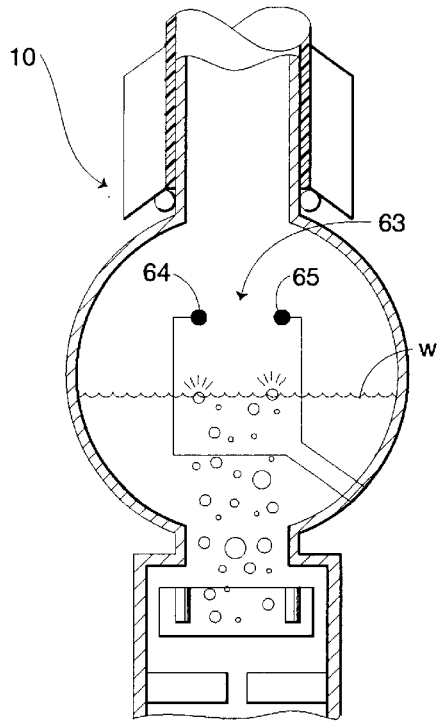
FIG. 2 is an enlarged side view in cross-section of a portion of the launcher of FIG. 1.
Figure 3:
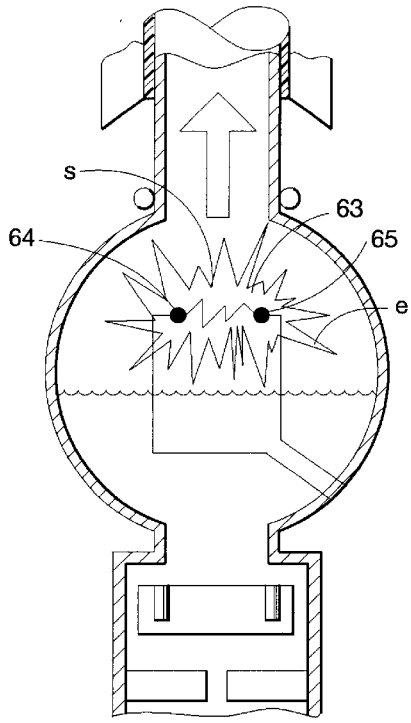
FIG. 3 is an enlarged side view in cross-section of a portion of the launcher of FIG. 1 shown launching a rocket.
Figure 4:
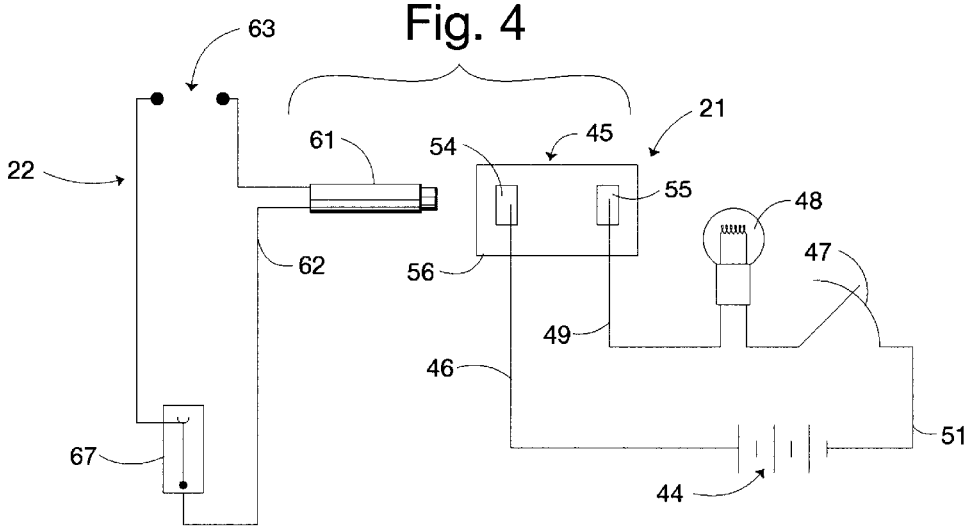
FIG. 4 is a schematic diagram of the vehicle launcher of FIG. 1.

With reference next to the drawings, there is shown a rocket launcher 10 in a preferred form of the invention. The rocket launcher 10 has a base unit 11 having a housing 12 which includes a stand 13 having a generally flat bottom surface 14, a separation unit 15 extending from the stand 13, and a launch tube 16 in fluid communication with the separation unit 15. The rocket launcher 10 also includes a hydrogen separation circuit 21 and an ignition circuit 22.

The separation unit 15 has a pressure sensing chamber 23 for sensing the pressure within the separation unit 15, a separation chamber 24 in fluid communication with the pressure sensing chamber 23 through a channel 25, and a combustion chamber 26 in fluid communication with the separation chamber 24 through a channel 27. The combustion chamber 26 is in fluid communication with the launch tube 16 through opening 28.

The pressure sensing chamber 23 has a tubular side wall 29 in which is mounted a disk shaped plunger 31 having a peripheral O-ring type seal 32 in sealing engagement with the interior surface of the side wall 29. The plunger 31 also has a coil spring 33 mounted about a central post 34 which biases the plunger upwards with reference to the drawings against the downward biasing force of increasing positive fluid pressure within the combustion chamber 26, separation chamber 24 and top portion of the pressure sensing chamber 23 above the plunger 31. The post 34 is mechanically coupled in conventional fashion to a pressure gauge 36 which indicates the pressure within the separation unit 15 through relative movement of the plunger 31.

The launch tube 16 has a top opening 38 in the top end thereof and a bottom opening 39 extending from combustion chamber opening 28. The launch tube is sized and shaped to be received within the bore 41 of an air rocket 42.

The hydrogen separation circuit 21 includes a battery pack 44, a fuel cell 45, a first conductor 46 extending between the battery pack 44 and the fuel cell 45, an on/off switch 47 and on-indicating light 48, a second conductor 49 extending between the fuel cell 45 and the on/off switch 47 and on-indicating light 48, and a third conductor 51 extending between the on/off switch 47 and on-indicating light 48 and the battery pack 44. Fuel cell 45 may also be termed an electrolysis cell or an electrolytic cell. The separation circuit 21 may also include a pressure safety switch coupled to plunger 31, or in fluid communication with the separation unit, so that when the fluid pressure reaches a predetermined level the pressure safety switch is actuated to electrically disconnect the fuel cell 45 from the battery pack 44.

The fuel cell 45 has a first gas diffusion electrode 54, a second gas diffusion electrode 55 and an ion transporting separator membrane 56, such as Nafion made by E.I du Pont de Nemours, mounted between the first and second gas diffusion electrodes. This type of fuel cell 45 is available from Stuart Energy System Corporation of Toronto, California and is described in U.S. Pat. No. 6,080,290. The fuel cell first gas diffusion electrode 54 is electrically coupled to the first conductor 46 while the second gas diffusion electrode 55 is electrically coupled to the second conductor 49.

The ignition circuit 22 includes a piezoelectric spark generator 61 mounted within the combustion chamber and coupled to a fourth conductor 62. Such spark generators are commonly found in conventional bar-b-que grills for igniting the propane, It should be understood that other means may be employed to generate a current as a substitute to the piezoelectric spark generator such as a battery and manually actuated switch. The fourth conductor 62 has a gap 63 at a location within the combustion chamber 26, i.e. the conductor 62 includes a first electrode 64 separated a short distance from a second electrode 65 each of which is positioned within the combustion chamber 26.

The ignition circuit 22 may include a safety switch 67 coupled to the conductor 62 to allow the passage of current therethrough only when the launch tube is in a preferred orientation. The preferred orientation of the launch tube may be vertical when the launcher is in the form of a rocket launcher or horizontal when the launch is in the form of a car, boat, motorcycle or other type of land or sea vehicle. The safety switch 67 may be in the form of a pendulum wherein the pendulum through which the current passes switch must be oriented vertically in order to close the circuit, otherwise the pendulum is off-set resulting in an open circuit.

In use, an electrolyte or electrolytic solution, in this instance water W, is poured into the separation unit 15 through the top opening 38 in the launch tube 16. The water passes through the launch tube 16 and into the combustion chamber 26 through bottom opening 39 and combustion chamber opening 28. A portion of the water W within the combustion chamber 26 flows through channel 27 and into the separation chamber 24, wherein a portion of the water flows through channel 25 into the top portion of the pressure sensing chamber 23 above the plunger 31. The water level within the combustion chamber 26 must be below the position of the electrodes 64 and 65 which form the gap 63.

Once the launcher 10 is filled with water to the appropriate level the on/off switch 47 is moved to its on position, thereby closing the hydrogen separation circuit 21 and energizing the on-indicating light 48. The electric current passing from the battery pack 44 to the fuel cell 45 causes the fuel cell to electrolyze the water, thereby causing the hydrogen to separate from the oxygen within the water. This process of separating oxygen and hydrogen within water is known as water electrolysis. In water electrolysis, electrical energy is used to separate water into its constituents, hydrogen and oxygen. This is done by passing an electric current between two metal surfaces (electrodes) through a conductive solution, hydrogen gas Hsub2 is formed at the negative electrode and oxygen gas ($O_2$) is formed at the positive electrode. This process is described in detail in U.S. Pat. No. 6,080,290 which is specifically incorporated herein by reference.

As the oxygen and hydrogen are separated the resulting gas bubbles of each rise to the surface of the water wherein the gases are contained within the combustion chamber 26. As the hydrogen and oxygen gases build within the combustion chamber 26 the pressure therein slowly increases. This increased pressure causes the plunger 31 within the pressure sensing chamber 23 to move downward, which in turn causes the dial of the pressure gauge 36 to move to the resulting pressure level indicated on the gauge.

Once the pressure has reached a desired level the operator moves the on/off switch 47 to its off position. The operator then actuates the piezoelectric spark generator 61, assuming the optional safety switch is oriented in a properly launched position. Should the operator not actuate the on/off switch 47 the pressure within the combustion chamber will reach a level wherein the movement of the plunger 31 actuates the optional pressure safety switch 37 so as to inactivate the hydrogen separation circuit 21 and thereby prevent the excessive buildup of hydrogen gas. The current produced by the actuation of the spark generator 61 causes a spark S to be produced between the electrodes 64 and 65 as the current arcs across the gap 63. This spark S ignites the hydrogen within the combustion chamber 26 and possibly a portion within the launch tube 16. The resulting explosion E from the ignited hydrogen causes a rapid pressurization within the launch tube 16 which propels the rocket 42, other vehicle or projectile, mounted thereon with a great velocity.

Figure 5:
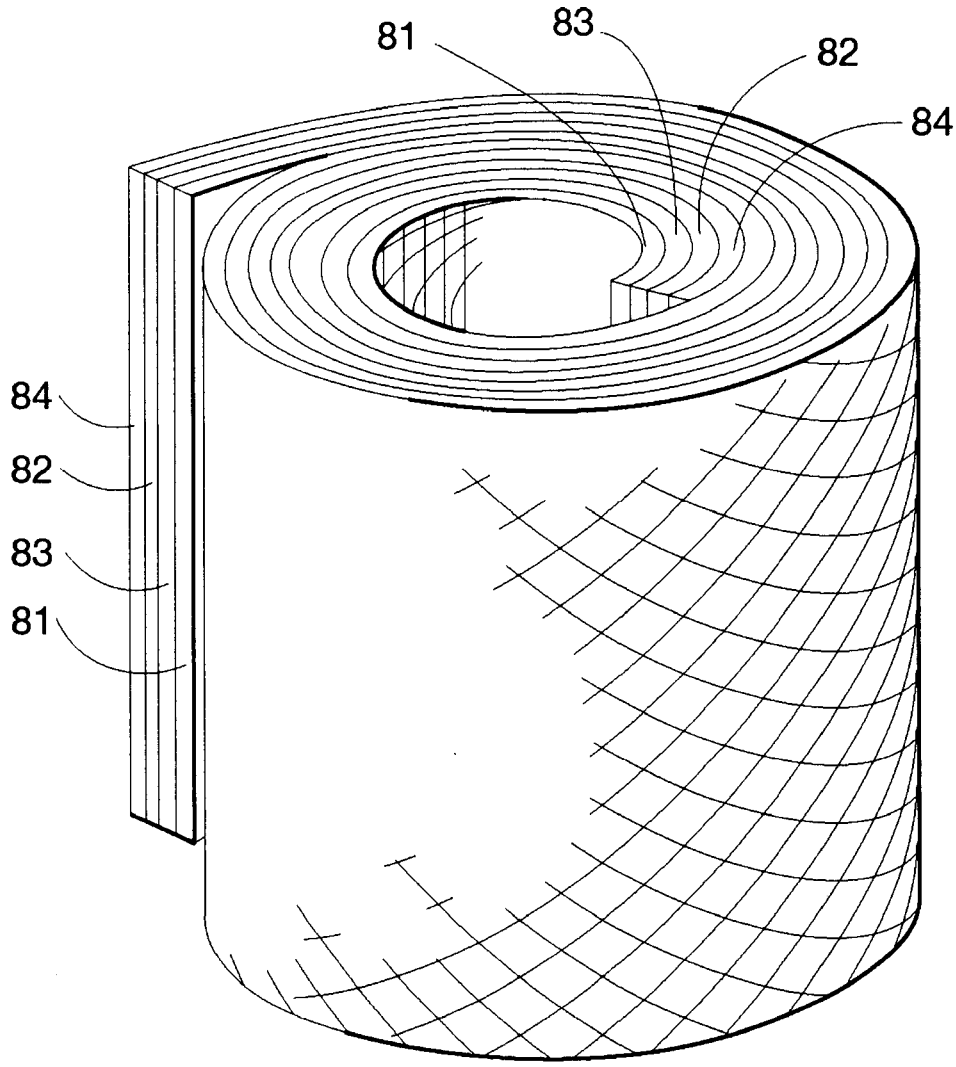
FIG. 5 is a perspective view of a fuel cell for a vehicle launcher in another preferred form of the invention.

With reference next to FIG. 5, there is shown a fuel cell 80 in another preferred form of the invention. Here, the fuel cell 80 has a first, mesh, stainless steel electrode 81 and a second, mesh, stainless steel electrode 82. The first and second electrodes 81 and 82 are formed at overlaying coils and are separated from each other by a fibrous, plastic insulator 83. Another fibrous, plastic insulator 84 is positioned outboard of the second electrode 82 so as to be positioned between the second electrode 82 and the next layer of the first electrode 81. The plastic insulator may be a polyester, nylon, cotton or other fiber material which is either woven or random so as to provide a wicking effect which enables liquids to flow between the electrodes. The electrolytic solution in this instance is a citric acid solution, such as diluted lemon juice. With the current passing through the first and second electrodes 81 and 82 the citric acid solution is electrolyzed and broken down into hydrogen, oxygen and carbon dioxide. The remaining portions of the device and the method associated therewith is essentially the same as that previously described in reference to the previous embodiment.

It has been found that by coiling the electrodes the electrolysis process may occur on both sides of the second electrode, as the first electrode is positioned adjacent both, opposite sides of the second electrode. This greatly increases the production of hydrogen and the overall efficiency of the electrolysis process.

It should be understood that the launch may be used to propel any type of projectile. Examples of such projectiles include toy vehicles mounted to the exterior of the launch tube, such as a model rocket, airplane, automobile, motorcycle, boat, etc., or a projectile or projectile portion mounted entirely or partially within the interior bore of the launch tube such as a pellet or a vehicle having a rod portion mounted within the launch tube.

It should be understood that the combustion chamber 26 and launch tube 16 of the preferred embodiment may be formed as one unit, i.e., the launch tube 16 may be part of the combustion chamber. Also, the combustion chamber and separation chamber 24 may be combined into one chamber. Furthermore, the pressure sensing chamber 23 may be combined with the separation chamber, alone or in combination with the combustion chamber. As such, the use of the term combustion chamber or separation unit as used herein may be used to describe the combustion chamber alone or in combination with the launch tube, separation chamber, pressure sensing chamber, or any combination thereof.

It should also be understood that the ignition circuit may be coupled with the hydrogen separation circuit so that the ignition spark is produced by current provided by the battery pack 44.

Lastly, it should be understood that any electrolytic solution may be used so long as it is compatible with a fuel cell such that it produces hydrogen during the electrolysis process. The term water used herein includes both water and water based solutions.

While this invention has been described in detail with particular reference to the preferred embodiments thereof, it should be understood that many modifications, additions and deletions, in addition to those expressly recited, may be made thereto without departure from the spirit and scope of invention as set forth in the following claims.

What is claimed is:

1. A launcher adapted to launch a projectile comprising:

a combustion chamber;

a launch tube in fluid communication with said combustion chamber configured to receive a projectile;

a separation chamber in fluid communication with said combustion chamber;

a fuel cell mounted within said separation chamber adapted to isolate hydrogen from a supply of water;

a power supply electrically coupled to said fuel cell; and spark generating means mounted within said combustion chamber for generating a spark to ignite gases within said combustion chamber, whereby water may be positioned within the separation chamber so as to immerse the fuel cell, and whereby energy supplied to the fuel cell causes it to convert a portion of the water into hydrogen gas and oxygen gas, and whereby the spark generating means ignites the hydrogen gas causing a rapid pressurization of the launch tube which causes a projectile thereon to be propelled.

2. The launcher of claim 1 further comprising a orientation sensitive safety switch to prevent the launcher from being actuated in an undesired orientation.

3. The launcher of claim 1 further comprising an over-pressurization safety switch which disconnects the fuel cell from the power supply upon reaching a desired pressure within the combustion chamber.

4. The launcher of claim 1 further comprising pressure gauge means for indicating the fluid pressure within said combustion chamber.

5. A launcher comprising:

a combustion chamber in fluid communication with a projectile launch tube;

a hydrogen producing fuel cell mounted in fluid communication with said combustion chamber adapted to separate hydrogen from a supply of water or water based solution;

a power supply electrically coupled to said fuel cell; and a spark generator mounted in fluid communication within said combustion chamber, whereby water or a water based solution may be positioned within the launcher so as to immerse the fuel cell, and whereby energy supplied to the fuel cell causes it to convert a portion of the water or water based solution into hydrogen gas and oxygen gas, and whereby the spark generator ignites the hydrogen gas causing a rapid pressurization of the launch tube which causes a projectile thereon to be propelled.

6. The launcher of claim 5 further comprising a orientation sensitive safety switch to prevent the launcher from being actuated in an undesired orientation.

7. The launcher of claim 5 further comprising an over-pressurization safety switch which disconnects the fuel cell from the power supply upon reaching a desired pressure within the combustion chamber.

8. The launcher of claim 5 further comprising pressure gauge means for indicating the fluid pressure within said combustion chamber.

9. A projectile launcher comprising:

a separation unit having a first portion adapted to contain a supply of water and a second portion adapted to contain a supply of gas;

a launch tube in fluid communication with said separation unit second portion;

means for separating hydrogen and oxygen from water so as to produce a quantity of hydrogen gas and a quantity of oxygen gas, said separating means being mounted within said separation unit first portion; and a spark generator mounted in fluid communication within said combustion chamber, whereby water may be positioned within the launcher separation unit first portion in fluid communication with the separation means so that the separation means produces a supply of hydrogen gas which is contained within said separation unit second portion, and whereby the spark generator ignites the hydrogen gas causing a rapid pressurization of the launch tube which causes a projectile thereon to be propelled.

10. The projectile launcher of claim 9 further comprising a orientation sensitive safety switch to prevent the launcher from being actuated in an undesired orientation.

11. The projectile launcher of claim 9 further comprising an over-pressurization safety switch which stops the actuation of the separation means reaching a desired pressure within the separation unit.

12. The projectile launcher of claim 9 further comprising pressure gauge means for indicating the fluid pressure within said separation unit.

* * * * *